US012735815B2

(12) United States Patent
Quaglio et al.

(10) Patent No.: US 12,735,815 B2
(45) Date of Patent: Sep. 15, 2026

(54) LASER WRITING IN AMBIENT CONDITIONS FOR CARBONIZATION OF SYNTHETIC POLYMERS, INCLUDING NANOSTRUCTURED POLYMERS TREATED IN ALKALINE MEDIA

(71) Applicants: POLITECNICO DI TORINO, Turin (IT); FONDAZIONE ISTITUTO ITALIANO DI TECNOLOGIA, Genoa (IT)

(72) Inventors: Marzia Quaglio, Turin (IT); Giulia Massaglia, Turin (IT); Eve Cecile J. Verpoorten, Turin (IT); Candido Pirri, Turin (IT)

(73) Assignees: POLITECNICO DI TORINO 95%, Turin (IT); FONDAZIONE ISTITUTO ITALIANO DI TECHNOLOGIA 5%, Genoa (IT)

( * ) Notice: Subject to any disclaimer, the term of this patent is extended or adjusted under 35 U.S.C. 154(b) by 80 days.

(21) Appl. No.: 18/872,342

(22) PCT Filed: Jun. 12, 2023

(86) PCT No.: PCT/IB2023/056025
§ 371 (c)(1),
(2) Date: Dec. 6, 2024

(87) PCT Pub. No.: WO2023/242701
PCT Pub. Date: Dec. 21, 2023

(65) Prior Publication Data

US 2025/0354303 A1 Nov. 20, 2025

(30) Foreign Application Priority Data

Jun. 13, 2022 (IT) ..... 102022000012500

(51) Int. Cl.

| | |
|---|---|
| ***D06M 10/00*** | (2006.01) |
| ***D01D 1/06*** | (2006.01) |
| ***D01D 5/00*** | (2006.01) |
| ***D01F 1/09*** | (2006.01) |
| ***D01F 9/22*** | (2006.01) |

(52) U.S. Cl.
CPC ..... *D01F 9/22* (2013.01); *D01D 1/065* (2013.01); *D01D 5/0007* (2013.01); *D01F 1/09* (2013.01); *D10B 2101/12* (2013.01); *D10B 2401/16* (2013.01)

(58) Field of Classification Search
CPC ..... D01D 1/065; D01F 1/22; D06M 10/005
See application file for complete search history.

(56) References Cited

U.S. PATENT DOCUMENTS

2017/0062821 A1 3/2017 Tour et al.

OTHER PUBLICATIONS

Go D et al., "Laser carbonization of pan-nanofiber mats with enhanced surface area and porosity", Applied Materials & Interfaces, vol. 8, No. 42, Oct. 26, 2016, pp. 28412-28417.

(Continued)

*Primary Examiner* — James Sanders
(74) *Attorney, Agent, or Firm* — Silvia Salvadori, P.C.; Silvia Salvadori

(57) ABSTRACT

Synthetic polymers in membrane or film or bulk form (continuous or micro-/nanostructured, supported or self-standing), if exposed to solutions of alkali hydroxides, can be carbonised by $CO_2$ laser writing under ambient conditions (without any inert gas in contact with the material), to obtain electrically conductive tracks and patterns.

10 Claims, 9 Drawing Sheets

(56) References Cited

OTHER PUBLICATIONS

Liu H et al., "Laser-induced and KOH-activated 3D graphene: a flexible activated electrode fabricated via direct laser writing for in-plane micro-supercapacitors", Chemical Engineering Journal, vol. 393, Mar. 5, 2020, p. 124672, retrieved from the Internet: URL: https://www.sciencedirect.com/science/article/pii/S138589472030663X/pdfft?md5=a0678503de3a5eda07b06c586b447654&pid=1-s2.0-S138589472030663X-main.pdf.

Search Report and Written Opinion of PCT/IB2023/056025 issued Nov. 21, 2023.

Sharifuzzaman MD et al., "Laser-carbonized mxene-reinforced hierarchical nanofibers for breathable and reusable electrophysiological E-tattos", 2021 21st International Conference on Solid-State Sensors, Actuators and Microsystems, IEEE, Jun. 20, 2021, pp. 904-907.

LASER WRITING IN AMBIENT CONDITIONS FOR CARBONIZATION OF SYNTHETIC POLYMERS, INCLUDING NANOSTRUCTURED POLYMERS TREATED IN ALKALINE MEDIA

This application is a U.S. national stage of PCT/IB2023/056025 filed on 12 Jun. 2023, which claims priority to and the benefit of Italian Patent Application No. 102022000012500 filed on 13 Jun. 2022, the contents of which are incorporated herein by reference in their entireties.

The invention relates to a process of carbonization of synthetic polymers by $CO_2$ laser treatment in alkaline conditions. The invention also relates to novel nanostructured materials obtainable by said process.

PRIOR ART

Carbonization of various types of polymers is used in numerous industries, in particular in the energy field (manufacture of electrodes, fuel cells, batteries and supercapacitors) and the sensor field (manufacture of electrodes, for electrochemical sensors) and to make separation and filtration membranes.

Under suitable conditions, polymer carbonization gives rise to the formation of graphene layers characterised by high conductivity, high resistance and a large surface area. Conventional carbonization processes are conducted in a furnace with a controlled atmosphere in terms of the gases ($N_2$, Ar, CO and $CO_2$ and mixtures containing oxygen, such as air) to which the sample may be exposed during heat treatment.

The use of irradiation techniques with laser pulses (Laser Induced Graphene or LIG) for carbonization of polyimides (Liu Huilong et al.) and polyetherimides is described in EP 3535214 and U.S. Pat. No. 20170062821. Laser writing enables spatially selective carbonization to be obtained for the production of electrically conductive carbon patterns and tracks.

Said process cannot be extended to other classes of polymers that form volatile compounds in oxygen-rich atmospheres. All the other known techniques for the treatment of synthetic (and also natural) polymers involve the use of inert technical atmospheres to induce carbonization, and/or the use of multiple laser passes.

In the case of cellulose (a natural polymer which cannot be processed by multiple laser writing under ambient conditions), the laser process under ambient conditions has been successfully designed on cellulose nanofibres (CNF) by means of multiple passes only and by oxidation of bleached pulp in TEMPO (2,2,6,6-tetramethylpiperidin-1-oxyl radical), sodium bromide and sodium hydroxide.

In the case of PVDF (a synthetic polymer), a carbonization process is reported following treatment with an alkaline bath, in combination with catalysts, at a high concentration, which modifies the polymer structure, by defluorination.

For all the other synthetic polymers, listed in the Supporting Information of the article Chyan et al., *ACS Nano* 2018, 12, 3, 2176-2183, https://doi.org/10.1021/acsnano.7608539, there is currently no technological solution which allows direct laser writing of conductive tracks in an ambient atmosphere.

SUMMARY OF THE INVENTION

It has now been found that laser-induced graphenization (LIG) techniques can also be applied under ambient conditions to any synthetic polymer treated with alkaline solutions of alkali hydroxides before exposure to $CO_2$ laser radiation.

In a first aspect thereof, the object of the invention is therefore a process for carbonization of synthetic polymers which comprises:

a) forming nano- or micro-structured films or fibres of said polymers;
b) treating the fibres or films obtained in step a) with alkaline solutions of alkali hydroxides;
c) treating the fibres or films obtained in step b) with a $CO_2$ laser under ambient conditions of the fibres or films obtained in step b);

wherein said synthetic polymers are selected from polyvinyl chloride, polyvinyl alcohol, polyethylene, polyethylene terephthalate, polyethylene naphthalate, polystyrene, polypropylene, polycarbonates, nylon 6,6, polymethacrylates, urea-formaldehyde resins, melamine-formaldehyde resins, teflon, polylactate, polyurethanes, high-density polyesters, fluorinated ethylene propylene copolymers, acrylonitrile butadiene styrene, polyacrylonitrile and polyvinylidene fluoride, and wherein the concentration of alkali hydroxides in said alkaline solutions ranges between 0.01M and 0.5M.

In a second aspect thereof, the invention relates to novel conductive porous materials obtainable by the carbonization process according to the invention.

In a third aspect thereof, the invention relates to a process for direct laser writing of conductive tracks according to a pre-determined pattern, which comprises:

a) forming nano- or micro-structured films or fibres of said polymers;
b) placing the fibres or films obtained in step a) on a support according to a pre-determined pattern, and treating with alkaline solutions;
c) treating the fibres or films obtained in step b) with a $CO_2$ laser under ambient conditions.

The materials obtained by treating polyacrylonitrile (PAN) and polyvinylidene fluoride (PVDF) under the process conditions according to the invention possess advantages over the prior art which will be exemplified below and are a further object of the invention.

The process according to the invention, unlike the carbonization/graphitisation technique in a furnace under a controlled atmosphere, allows the creation of directly laser-written conductive tracks and patterns, transforming the material in a localised way, only in the areas that interact with the laser, with no need for technical gases or equipment designed to contain and monitor them.

The process according to the invention also allows carbonization in an ambient atmosphere of synthetic polymers which cannot be processed by known methods.

The process and materials according to the invention are suitable for use in the electrochemical field, specifically for the preparation of porous carbon electrodes, in particular for low/medium temperature fuel cells (PEM-FC) and electrochemical sensors (e.g. pH, glucose, etc.). Graphene materials obtained by carbonization of synthetic polymers in accordance with the invention, using direct laser writing of conductive tracks, allow the manufacture of flexible, wearable devices, and use as conductive patterns/tracks in electrical conductors.

DETAILED DESCRIPTION OF THE INVENTION

Figure 1:
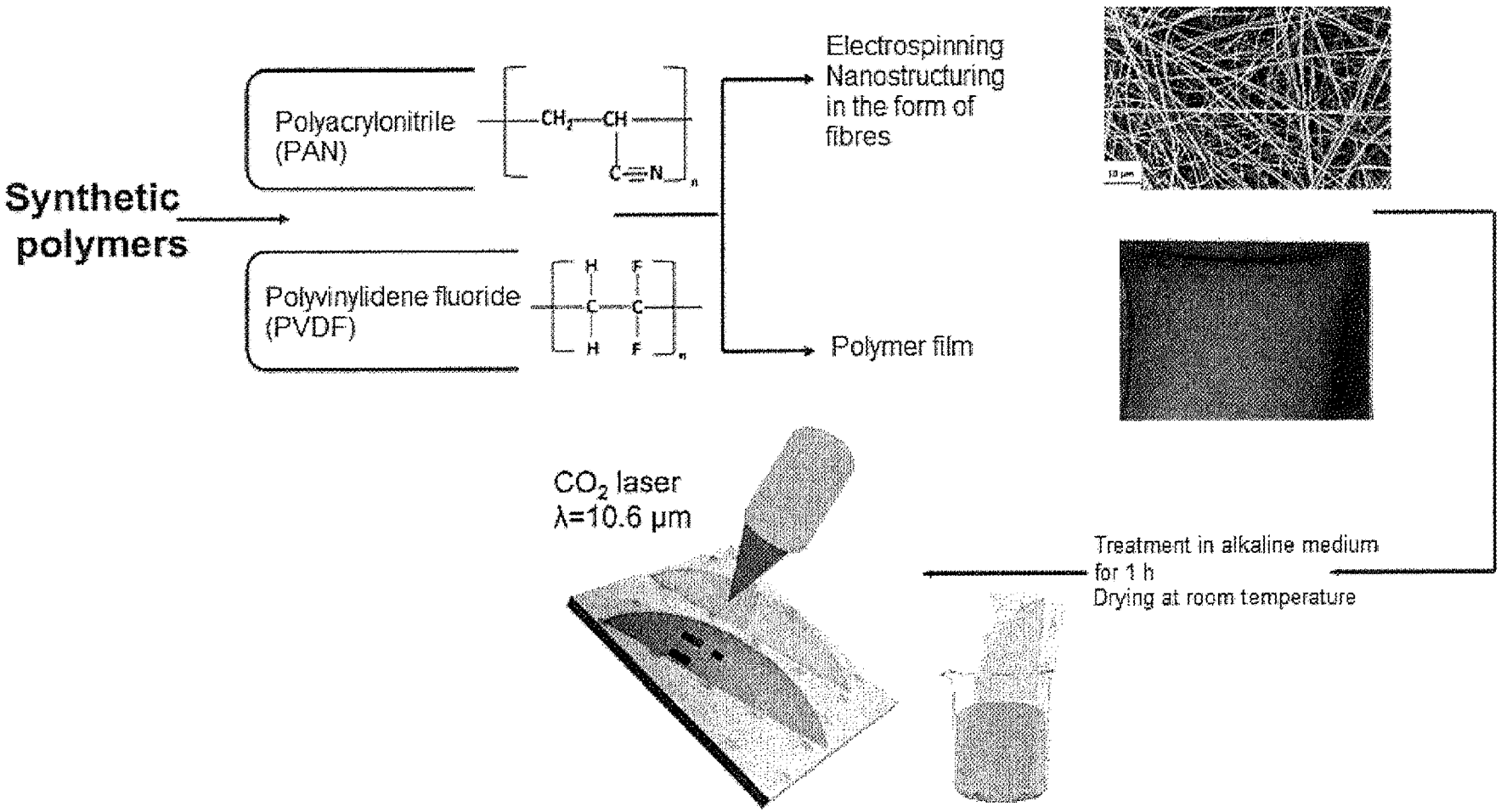
FIG. 1 illustrates a scheme of the process according to the invention.

The invention is illustrated below with specific reference to polyacrylonitrile and polyvinylidene fluoride. The techniques reported below are also applicable to other synthetic polymers, such as polyvinyl chloride, polyvinyl alcohol, polyethylene, polyethylene terephthalate, polyethylene naphthalate, polystyrene, polypropylene, polycarbonates, nylon 6,6, polymethyl methacrylates, urea-formaldehyde resins, melamine-formaldehyde resins, teflon, polylactate, polyurethanes, high-density polyesters, fluorinated ethylene propylene copolymers and acrylonitrile butadiene styrene, with similar results.

In the present invention, the following terms have the meanings specified below:

"nanostructured", relating to a film or fibre made of synthetic polymers or copolymers, means a material whose structural properties depend on constituents wherein at least one of the 3 dimensions is smaller than 100 nm. In particular, the present invention refers to material obtained in the subform of nanofibres. Said material can be obtained by the electrospinning process. The specific nanofibres according to the invention therefore represent an important example of convergence of the nanometric world, due to their diameter, with the macroscopic world, due to their lengths, which can be up to several metres.

"microstructured", when referring to a film or fibre made of synthetic polymers or copolymers, means a size in the micrometric range; in particular the term microstructure is used of a material when the typical size of the edges of the grain, and of the various crystalline structures that commonly form it, are defined;

"technical gas" means a gas that alters the ambient atmosphere in terms of air, ie. pure nitrogen and argon;

"ambient conditions" and "ambient atmosphere" mean not containing any inert gas alone in contact with the material, in the presence of air, ie. a mixture of inert gas and oxygen, and at room temperature;

"room temperature" means a temperature of about 20-25° C.

The present invention therefore relates to carbonization of synthetic polymers which comprises:

a) forming nano- or micro-structured films or fibres of said polymers;

b) treating the fibres or films obtained in step a) with alkaline solutions of alkali hydroxides;

c) treating the fibres or films obtained in step b) with a $CO_2$ laser under ambient conditions;

wherein the synthetic polymers are selected from polyvinyl chloride, polyvinyl alcohol, polyethylene, polyethylene terephthalate, polyethylene naphthalate, polystyrene, polypropylene, polycarbonates, nylon 6,6, polymethacrylates, urea-formaldehyde resins, melamine-formaldehyde resins, teflon, polylactate, polyurethanes, high-density polyesters, fluorinated ethylene propylene copolymers, acrylonitrile butadiene styrene, polyacrylonitrile and polyvinylidene fluoride; and wherein the concentration of alkali hydroxides in the alkaline solutions of step b) ranges between 0.01 and 0.5M.

The process according to the invention is applicable to polymers or copolymers belonging to the thermoplastic class, such as:

aliphatic polymers derived from alkenes, such as PE and PP synthetic polymers derived from acrylonitrile, such as polyacrylonitrile, acrylonitrile butadiene styrene (ABS) and nylon polymers with vinyl functionality, such as polyvinyl alcohol (PVA) and polyvinyl chloride (PVC)

fluorinated polymers, such as teflon, polyvinylidene fluoride (PVDF) and fluorinated ethylene propylene (FEP)

polyurethane polymers aromatic polymers derived from styrene polyesters, such as polycarbonate, polyethylene terephthalate (PET), polyethylene naphthalate (PEN) and polylactic acid (PLA).

The process according to the invention is also applicable to polymers belonging to the thermosetting class, such as:

melamine resins, synthetic thermosetting resins obtained by polycondensation of formaldehyde with melamine urea-formaldehyde resins, and synthetic thermosetting resins obtained by reacting urea and formaldehyde.

The synthetic polymers or copolymers used in the process according to the invention are selected from polyvinyl chloride, polyvinyl alcohol, polyethylene, polyethylene terephthalate, polyethylene naphthalate, polystyrene, polypropylene, polycarbonates, nylon 6,6, polymethacrylates, urea-formaldehyde resins, melamine-formaldehyde resins, teflon, polylactate, polyurethanes, high-density polyesters, fluorinated ethylene propylene copolymers, acrylonitrile butadiene styrene, polyacrylonitrile and polyvinylidene fluoride.

The concentration of the alkali hydroxides in the alkaline solutions of step b) ranges between 0.01 and 0.5M.

The treatment with alkaline solutions of alkali hydroxides according to step b) produces nano- or micro-structured films or fibres of the polymers of step a), which are suitable to undergo the subsequent carbonization step c) without the use of inert technical atmospheres to induce carbonization and/or the use of multiple laser passes, nor the development of any chemical/physical alteration of the synthetic polymers used, such as defluorination.

Said treatment with alkaline solutions according to step b) is carried out in the presence of alkali hydroxides only, namely without adding further ingredients, for example phase-transfer catalysts such as quaternary ammonium salts, thus avoiding interactions that could give rise to alterations in the polymer chain liable to promote the carbonization process.

Moreover, the specific concentration interval of the alkaline solutions, preferably of the alkaline solutions of alkali hydroxides, ranging from 0.01M to 0.5M, which is usable in step b) of the process according to the invention, allows the use of a low concentration of hydroxides in the alkaline bath and further prevents any possible chemical alteration of the starting polymer, such as defluorination.

In step a) of the process, the films or fibres of synthetic polymers or copolymers can be prepared by evaporation under ambient conditions of solutions of the polymers in suitable solvents, at concentrations typically ranging between 10 and 20% by weight.

The suitable solvents used in step a) are preferably selected from polar aprotic solvents such as acetone, ethanol and dimethylformamide, and protic solvents such as water.

More preferably the solvents are acetone, dimethylformamide, ethanol and water.

Said solvents can therefore be either polar or apolar, provided that they ensure correct, optimum solubilisation of the starting polymer, to ensure that a uniform polymer solution is obtained.

The same solutions can be used to prepare nano- or micro-structured fibres by electrospinning in step a).

Electrospinning is an electro-hydrodynamic process which, starting with a polymeric solution characterised by suitable viscosity, and following the application of a suitable external electrical field, gives rise to the formation of a charged polymer jet, the diameter of which is gradually reduced to a diameter characteristic of nanofibres, ie. ranging between a few microns and a few nanometres.

Said reduction in diameter is closely correlated with the electrostatic instability generated due to the interactions between the charges distributed in the jet throughout the process. Said instabilities therefore cause the polymer jet to stretch, with consequent diameter thinning. During the flight time, defined as the distance between the two electrodes to the ends of which the external electrical field is applied, the solvent of the polymer solution evaporates, causing solidification and deposit of solid nanofibres on a substrate (placed on the electrically earthed collector).

Electrospinning is the most advantageous technology able to guarantee the deposit of a bundle of nanofibres, the diameter of which is defined as ranging from a few microns to a few dozen nanometres. The nanofibres thus obtained also possess important intrinsic properties, such as a high surface area relative to the volume occupied, high porosity, and distribution of their diameters amounting to a few nanometres.

Preparation of a polymeric solution with defined rheological properties is therefore a crucial requirement to guarantee the efficacy of the electrospinning process.

The polymers of step a) are preferably selected from polyacrylonitrile and polyvinylidene fluoride.

In a preferred embodiment of the invention, the polymer solution used to form the films or fibres of step a) has a viscosity ranging between 0.1 and 2 Pa*s.

In step b), the alkali hydroxides are selected from NaOH and KOH, preferably NaOH.

In step b), the concentration of the alkali hydroxides, preferably NaOH, of the alkaline solutions ranges between 0.01 and 0.5 M, and the duration of the treatment can preferably range from 10 min to about 2 hours, at room temperature.

In step b), the concentration of the alkali hydroxides, preferably NaOH, of the alkaline solutions preferably ranges between 0.01 and 0.1, more preferably ranges between 0.01 and 0.05, and even more preferably is 0.05 M.

The alkaline treatment according to step b) of the nano- or micro-structured films or fibres is performed, for example, by immersion in solutions of alkali hydroxides in suitable solvents, in particular $C_1$-$C_4$ alcohols, preferably in ethanol solutions of alkali hydroxides.:

In step c), the $CO_2$ laser treatment is carried out on the films or fibres or membranes of step b) under ambient conditions, ie, in the presence of air, and at room temperature, ie. a temperature of about 20-25° C.

The main application of the porous carbon electrodes obtained by laser writing is in low/medium temperature fuel cells (PEM-FC).

Figure 7:
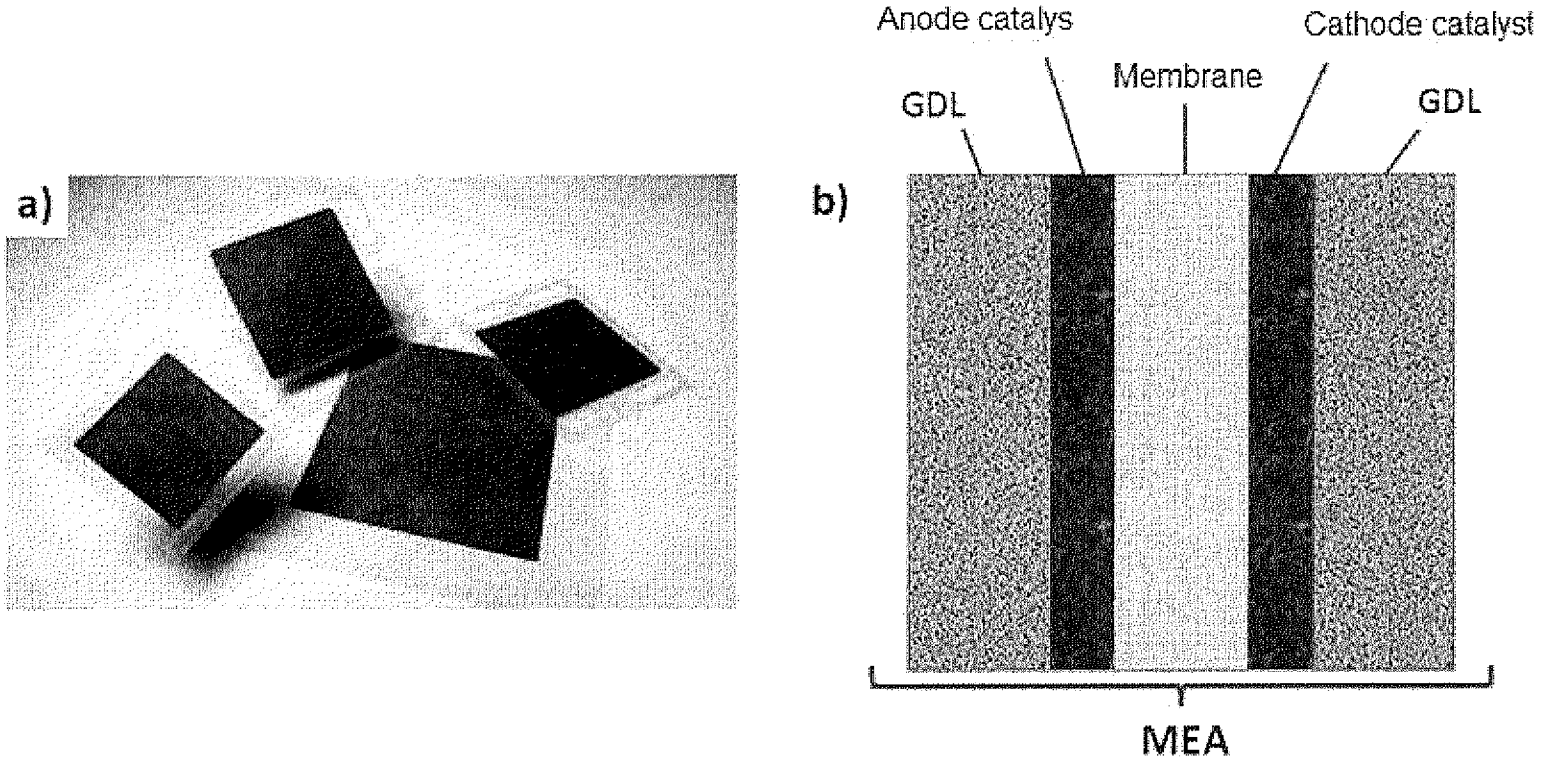
FIGS. 7*a* and *b* show images of commercial Membrane Electrode Assemblies (MEAs) and the schematic representation of an MBA respectively.

The heart of PEM fuel cells is the Membrane Electrode Assembly (MEA), which consists of a proton exchange membrane (the electrolyte) inserted between two gas diffusion electrodes (GDE) (anode and cathode), as shown in FIG. 7.

PEM-FCs require major efforts to reduce costs, a factor which has so far prevented their growth. The main contribution to the cost is determined by the gas diffusion electrode (GDE).

The processes according to the invention proposed herein, including the process for direct laser writing of conductive tracks according to a pre-determined pattern, which comprises:

a) forming nano- or micro-structured films or fibres of said polymers;
b) placing the fibres or films obtained in step a) on a support according to a pre-determined pattern, and treating with alkaline solutions;
c) treating the fibres or films obtained in step b) with a $CO_2$ laser under ambient conditions, represent an advantageous alternative for the manufacture of said electrodes, ensuring a considerably reduced cost among other advantages.

Figure 8:
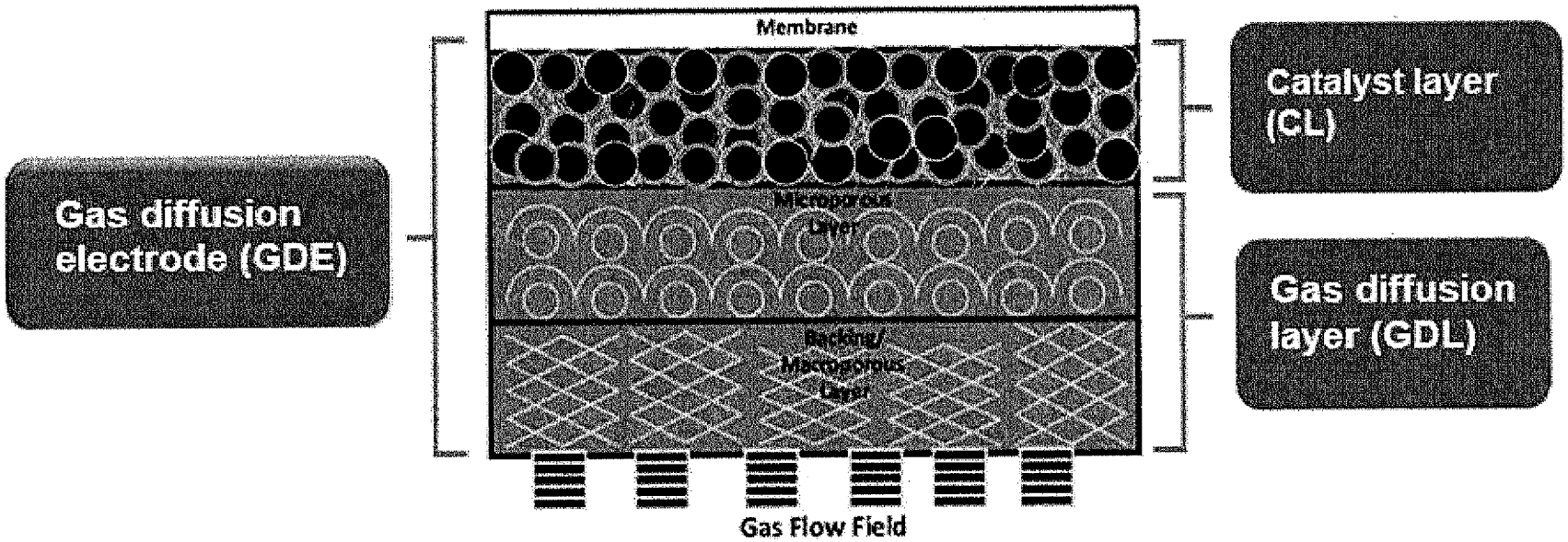
FIG. 8 illustrates a main component of a fuel cell (gas diffusion electrodes, GDEs) and a PEM electrolyser (low/medium temperature fuel cells: the 2D view shows the key functional components of a GDE, in particular the catalyst layer (CL) and the gas diffusion layer (GDL)

The GDE consists of a gas diffusion layer (GDL) and a catalyst layer (CL), as schematically illustrated in FIG. 8:

the GDLs, which facilitate gas diffusion, assist the transport of electrons and heat from the active sites of the material, and protect the MEA;

the catalyst layer CL, which contains the active sites wherein the electrochemical reaction takes place. The latter must possess optimum mass transport. characteristics.

Due to its intrinsic physicochemical properties, such as a high surface area, high electrical conductivity and a porous structure, carbon is the most suitable choice, and is used to support the gas diffusion layer (GDL) and the catalyst layer (CL). In PEM-FCs, the catalyst layer, due to both the anodic reaction and the cathodic reaction, usually consists of platinum.

Substituting carbon materials for platinum would make a significant contribution to reducing costs. Particular attention needs to be given to the catalysts developed at the cathode, which must guarantee electrochemical properties suitable for the oxygen reduction reaction.

The suitability of the material as a conduction catalyst layer is demonstrated by the number of electrons that the CL is able to provide; it is known from the literature that the ideal number of electrons to guarantee the direct oxygen reduction reaction, avoiding the intermediate reduction reaction, is 4 (guaranteed by platinum).

A further object of the present invention is therefore the conductive porous materials obtained by carbonization of polyacrylonitrile or polyvinylidene fluoride by the process according to the invention, and the use of both products (conductive porous materials and fibres or films) obtained by the processes according to the invention in the electrochemical field, preferably in low/medium temperature fuel cells (PEM-FC).

Advantageously, the products obtained by the processes according to the invention can be used as porous carbon electrodes or as electrochemical sensors, preferably as gas diffusion electrodes (GDE) or electrochemical sensors of pH and glucose.

Finally, a further object of the present invention is the use of the fibres or films obtained by direct laser writing of conductive tracks by the process according to the invention as conductive patterns/tracks in electrical conductors.

Experimental Part

A complete representation of the process according to the invention, comprising steps a) to c), is provided in FIG. 1.

Example 1—Preparation of the Polymer Mixtures According to the Invention

In order to deposit PAN and PVDF in the form of membranes or fibres or films or bulk product (continuous or micro-/nano-structured, supported or self-standing), two different polymeric solutions were synthesised and optimised. In particular, PAN was dissolved in a polar solvent such as N, N-dimethylformamide to obtain a polymer solution containing 12% by weight of polymer, the percentage being calculated on the basis of the solvent fraction.

The polymer solution containing 19% PVDF was obtained by dissolving 2 g of polymer in a mixture of polar solvents, acetone and dimethylformamide at a volumetric. ratio of 1 to 1. Said two polymer solutions were optimised not only for depositing a continuous polymer membrane, but also to ensure the efficacy of the electrospinning process implemented for the manufacture of nanostructured membranes.

Example 2—Electrospinning (Step a) of the Polymer Mixtures Obtained as Described in Example 1 to Obtain the Fibres According to the Invention The nanostructured PAN membrane or fibre or film was obtained by electrospinning, applying a potential of 12 kV with a distance of 12 cm between the two electrodes, and defining a flow rate of 0.5 mL/h. By defining a process duration of 2 h, a nanostructured membrane or fibre or film with a thickness of 10 μm was deposited. In the case of the nanostructured PVDF membrane (Sigma-Aldrich), the electrospinning parameters set required an applied potential of 26 kV, a work distance of 13.5 cm and a flow rate of 0.5 mL/h. The PVDF membrane or fibre or film has the same thickness, ie. 10 μm, obtained by defining a process time of 2 h. For both of said polymers, the substrate selected and suitably positioned on the collector during the electrospinning process was a silicon wafer with a deposited or grown layer of $SiO_2$, able to guarantee an insulating surface whereon the nanostructured and continuous membranes were collected.

The continuous membranes or fibres or bulk films of PAN and PVDF were obtained by depositing 1 mL of polymer solution to obtain a continuous membrane or fibres or films with the same amount of polymer, either PAN or PVDF, obtained by the electrospinning process. The solvent fraction contained in the polymer solution was evaporated under ambient temperature and humidity conditions.

Example 3—Treatment with Alkaline Solutions of Alkali Hydroxides (Step b)

The samples (membranes or fibres or films) obtained according to Example 2, either in nanostructured form or in continuous form (bulk), were subsequently treated in an alkaline medium by immersion of the materials in a solution containing various concentrations of sodium hydroxide (NaOH), dissolved in ethanol. Two different concentrations of NaOH were tested, namely 0.05M and 0.1M, to evaluate whether the NaOH concentration can influence the carbonization process obtained by $CO_2$ laser writing under ambient conditions. The bulk and nanostructured membranes were immersed in alkaline solution for 1 h and then dried at room temperature, ensuring total evaporation of the solvent. At the end of the treatment in alkaline medium according to step b), no rinsing in water or other different types of solvent was applied to the membranes or fibres or films, to ensure that rinsing did not interfere with the treatment.

Example 4—$CO_2$-laser-induced carbonization treatment under ambient conditions (step c)

The carbonization induced by $CO_2$ laser writing in continuous mode was then studied on all the samples obtained according to Example 3. In particular, a commercial $CO_2$ laser (Laser Scriber MIC-LS0002, $\lambda$=10.6 μm) with a maximum power output of 30 W, characterised by a writing speed of 500 cps, was used for the carbonization process. The various electrically conductive tracks and patterns were obtained by laser writing with a power of 4 W and a scanning speed of 500 mm/s at the focal point. The intensity, movement speed and number of irradiations were regulated to study the carbon material produced. In particular, a number of laser exposures ranging from 1 to 3 were implemented, while the frequency set, amounting to 10 kHz, was defined to ensure a continuous laser emission. Two different planar geometries were implemented to demonstrate the ability to obtain electrically conductive tracks independently of the geometry selected. In particular, the first geometry is a rectangle having a width of 8 mm and a height of 4 mm; while the second geometry is a square with 2 mm sides. The laser writing was obtained by defining a filling for crossed lines, characterised by line spacing of 0.03 mm and a 0° angle of incidence of the laser relative to the sample.

Example 5—Morphological Analysis of Samples Obtained According to Example 4

A morphological analysis was conducted to verify the preservation of the nanostructure even after laser writing, especially as regards the nanostructured membrane or film or fibre. An electrical conductivity evaluation was also carried out to define the presence of electrically conductive tracks obtained by laser writing.

Figure 2:
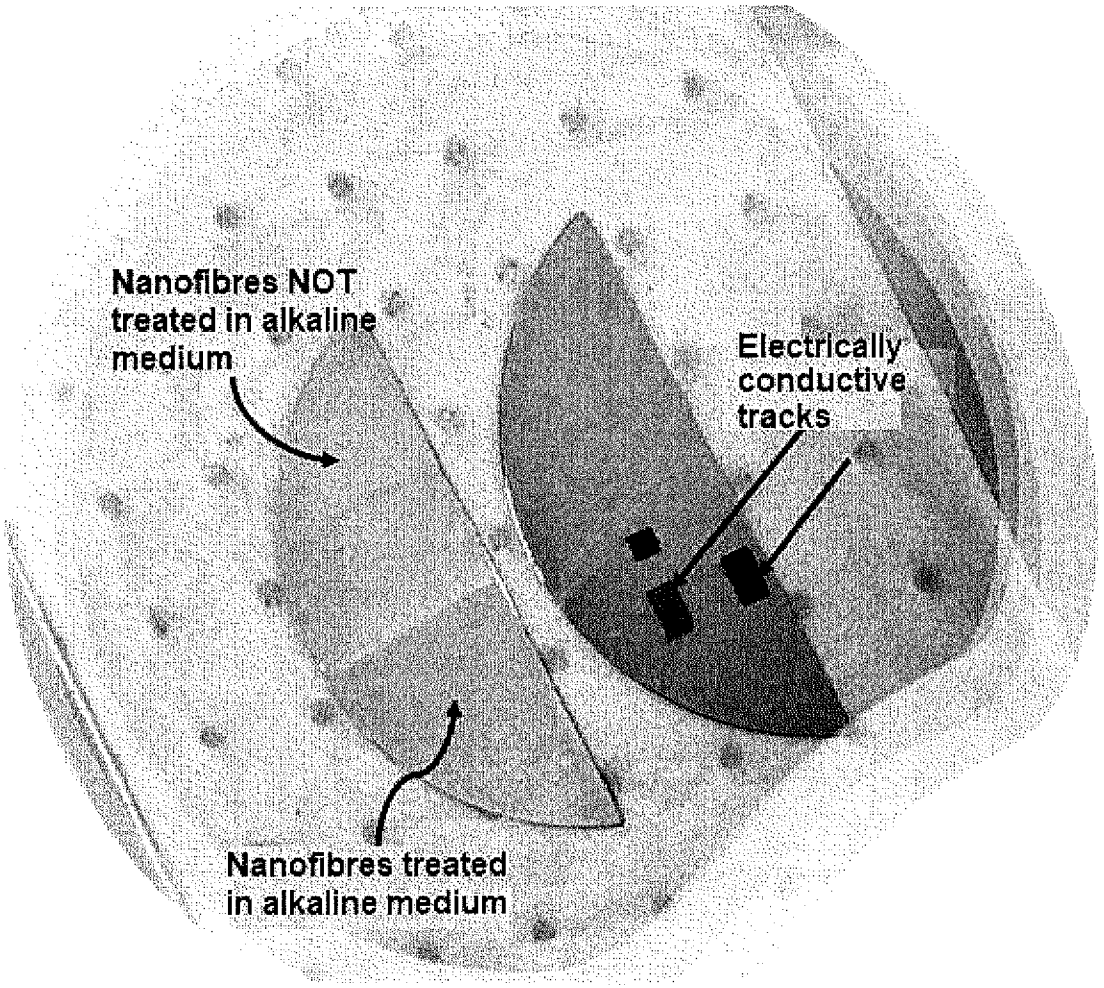
FIG. 2 shows the macroscopic evaluation of the effects induced by the treatment in an alkaline medium on nanostructured PAN and PVDF membranes.

FIG. 2 shows the macroscopic evaluation of the effects induced by the treatment in an alkaline medium on nanostructured PAN and PVDF membranes. In particular, a darker area can be observed, representing the effects of the treatment. As shown in FIG. 2, it was also possible to verify the presence of electrically conductive tracks following the laser writing. The presence of black areas can be observed, reflecting the geometries defined at the time of implementation of the laser process, ie. the first geometry defined by an 8×4 $mm^2$ rectangle and a second geometry represented by a 2×2 $mm^2$ square.

Figure 3:
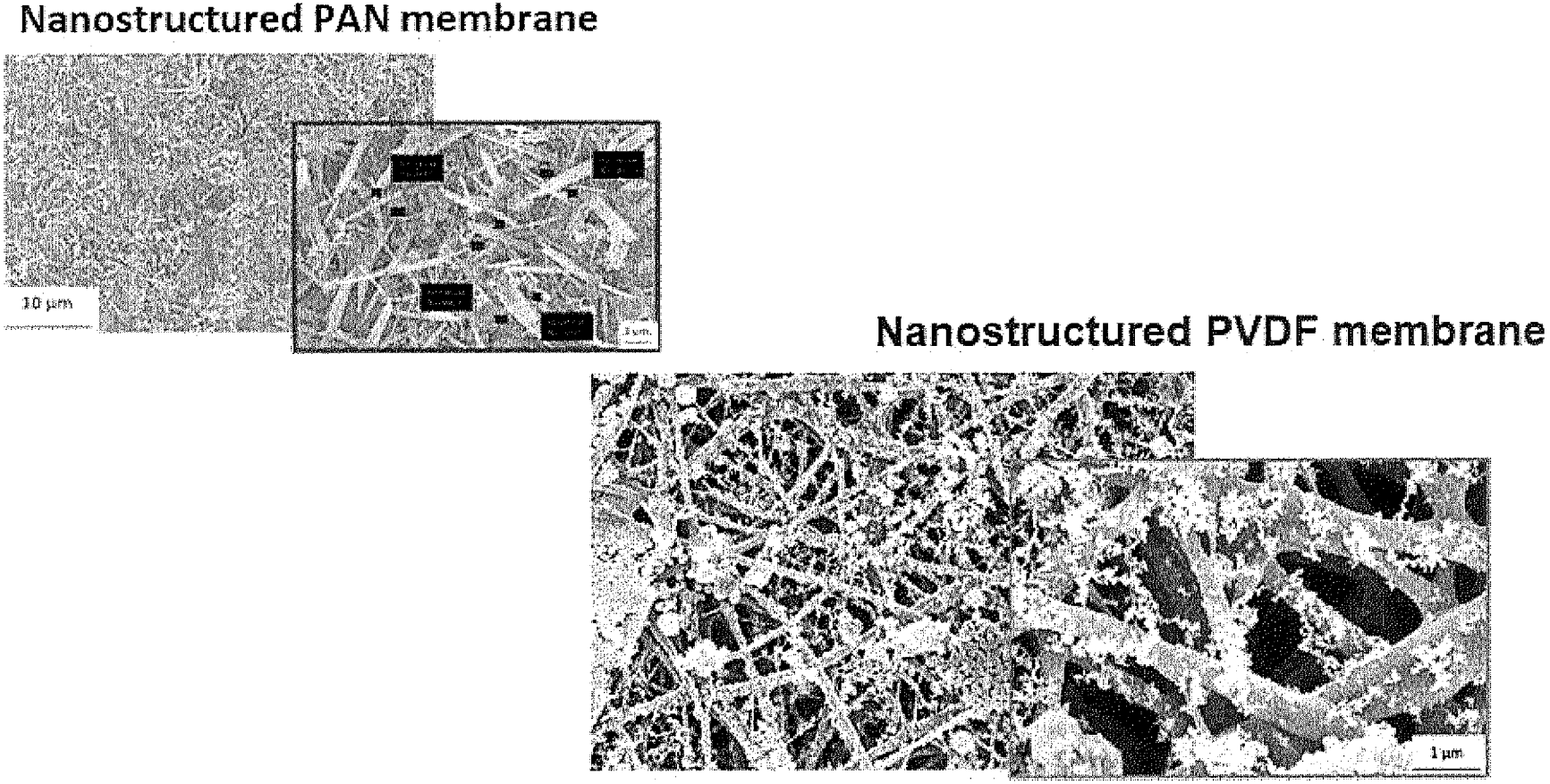
FIG. 3 shows the morphological analysis under the scanning electron microscope of nanostructured PAN and PVDF membranes obtained by the process according to the invention.

A morphological analysis was then conducted with a scanning electron microscope (SEM) to determine the preservation of nanostructures even after the laser writing process applied to the nanostructured PAN and PVDF membranes. FIG. 3 illustrates nanostructured PAN (left) and PVDF (right) membranes exposed to the maximum number of laser exposures (number of exposures=3). The panels below represent enlarged versions of the images above. The images confirm the preservation of nanostructures even after exposure to the laser, ensuring maintenance of a high surface area relative to volume, an intrinsic characteristic of nanostructured membranes obtained by the electrospinning process.

Example 6—Analysis of electrical conductivity of samples obtained according to Example 4

Figure 4:
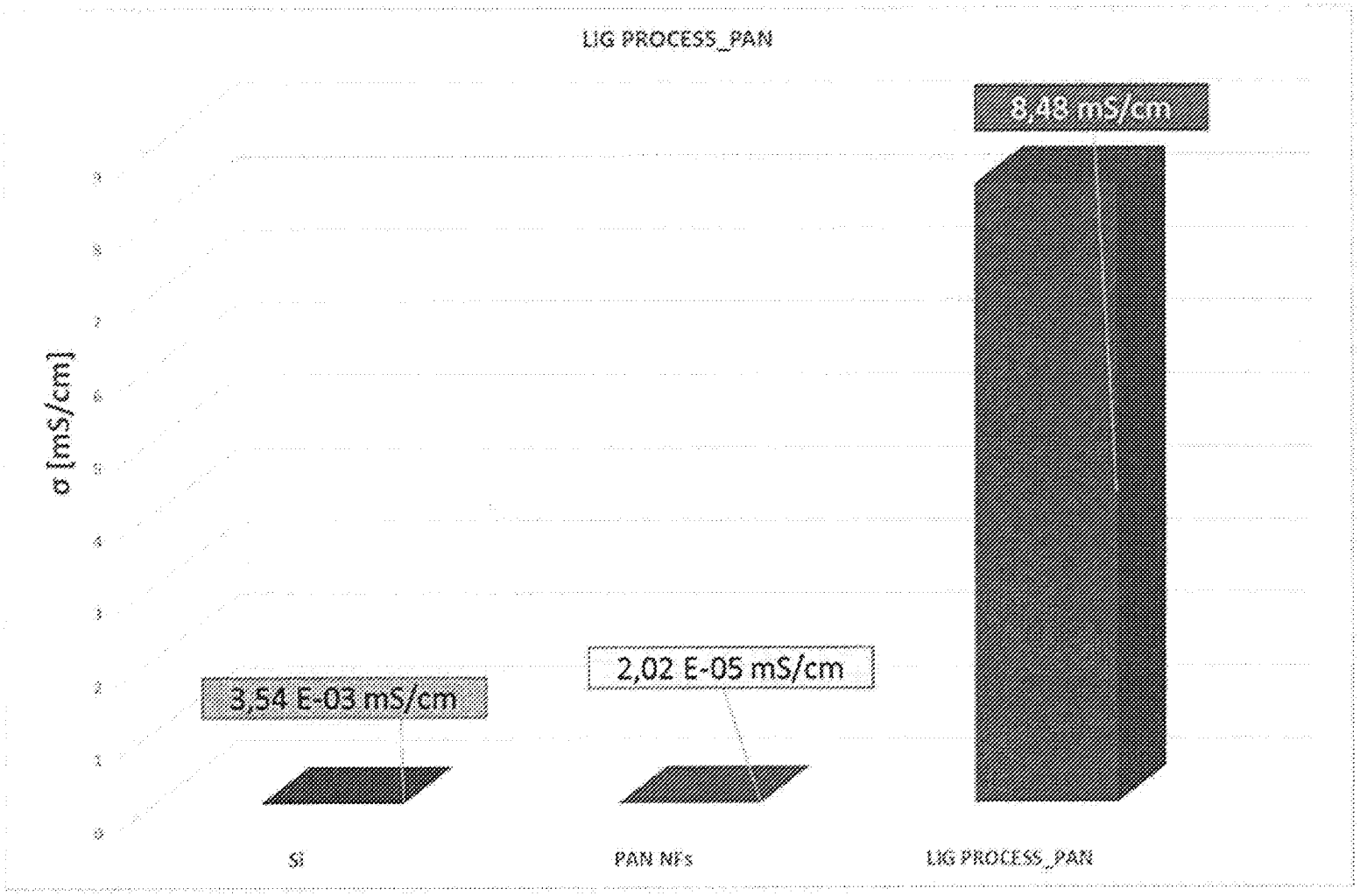
FIG. 4 shows the electrical conductivity values for configurations made with the nanostructured PAN membranes obtained by the process according to the invention.
Figure 5:
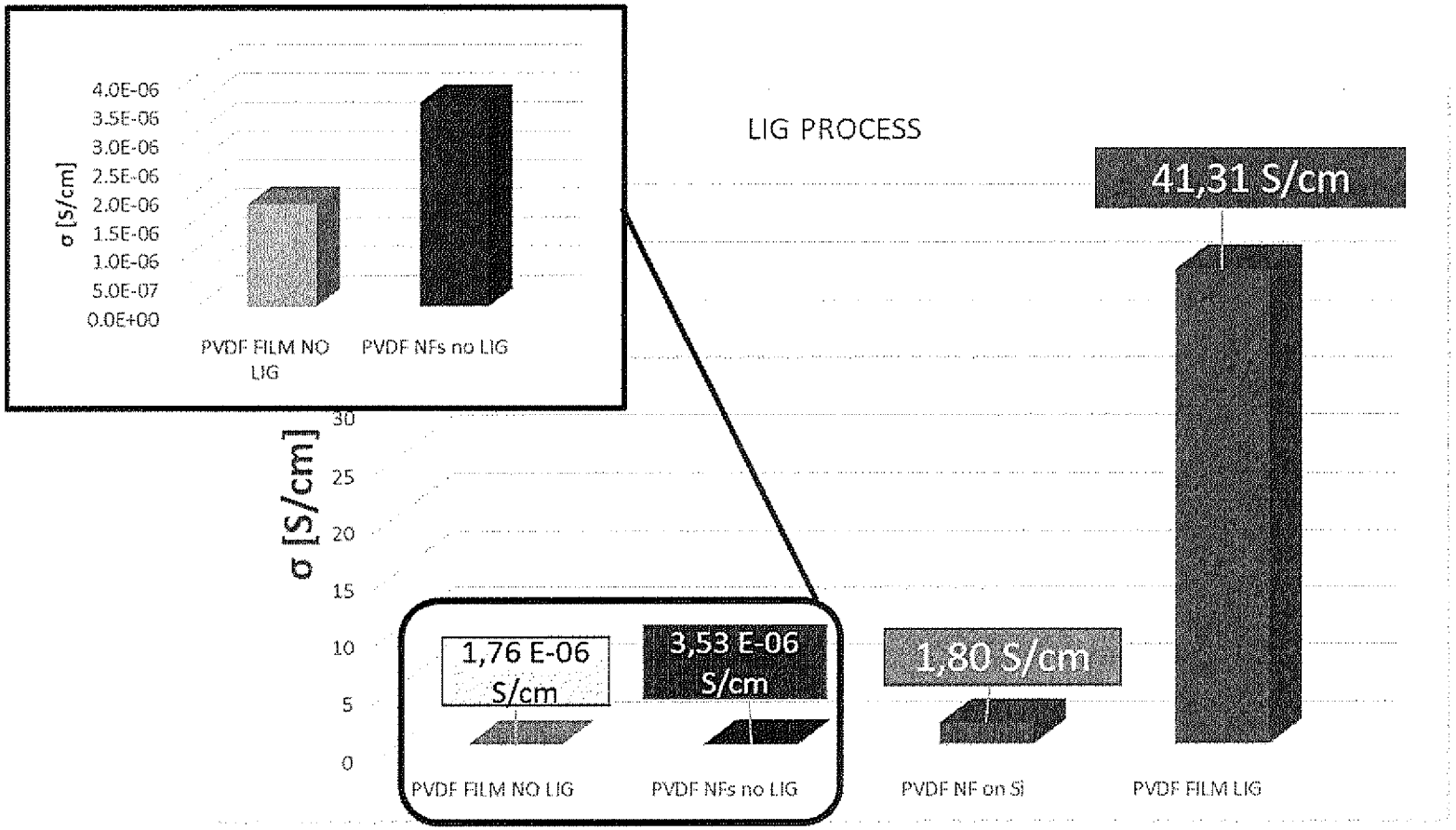
FIG. 5 shows the electrical conductivity values for configurations made with both nanostructured and continuous PVDF membranes obtained by the process according to the invention.

An electrical conductivity test was then conducted on both continuous and nanostructured PAN and PVDF membranes or films or fibres, to demonstrate the efficacy of laser writing in creating electrically conductive tracks. The surface resistance $R_5$ is considered in order to analyse electrical conductivity, as extensively discussed in the literature. Said measurement is defined as the resistance value mainly used with thin films of uniform thickness. The resistivity, and therefore the electrical conductivity, defined as its inverse, is calculated according to Ohm's second law. To calculate the resistance, a two-probe measurement technique was used with a multimeter (Keithley 2635A) so that the material could be stressed with a variable applied voltage and the current generated in the material consequently measured. The electrical conductivity analysis was conducted on three different samples: i) silicon substrate with growth of $SiO_2$, used as control; ii) continuous and nanostructured PAN and PVDF membranes on which laser writing had not been performed to create electrically conductive tracks; iii) the electrically conductive tracks obtained by said laser writing. FIGS. 4 and 5 show the values of the three samples described above for PAN and PVDF.

Said figures demonstrate that for both materials analysed, the use of laser writing to create electrically conductive patterns/tracks increases the electrical conductivity of the samples by more than 7 orders of magnitude compared with the control samples.

Example 7—Raman Analysis of Samples Obtained According to Example 4

Figure 6:
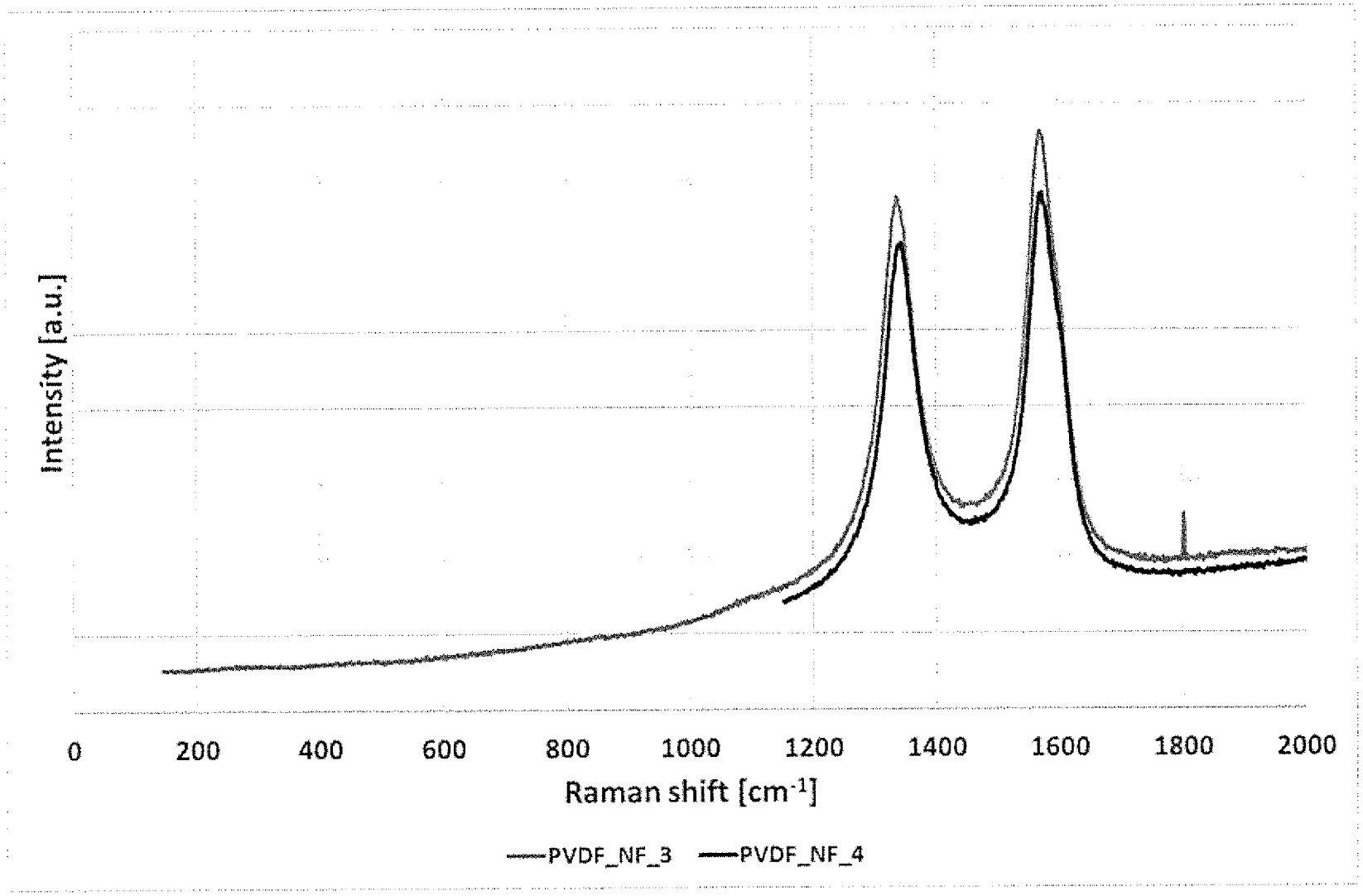
FIG. 6 shows the RAMAN spectra of the nanostructured PAN and PVDF membranes obtained by the process according to the invention.

A RAMAN (Renishaw InVia Reflex spectrometer, hex=514.5 nm) physicochemical characterisation was then conducted to verify the graphite characteristics induced by laser writing. FIG. 6 shows the presence of the second peak (G-peak) at a wavelength of 1581 $cm^{-1}$, representing the graphite part of the material analysed. The first D-peak, positioned at a wavelength of about 1366 $cm^{-1}$, is correlated with the disordered portion of the carbon materials. It should be noted that the D-peak has an intensity less than that of the G-peak, demonstrating the graphene-like characteristic/properties/structure of the material obtained by laser writing.

Example 8—Electrochemical Analysis of Samples Obtained According to Example 4

The electrochemical characteristics of the carbon materials obtained by laser writing by the method according to the present invention were verified by Rotating Ring Disk Electrode (RRDE) measurements, which determine the number of electrons guaranteed by the carbon material.

Figure 9:
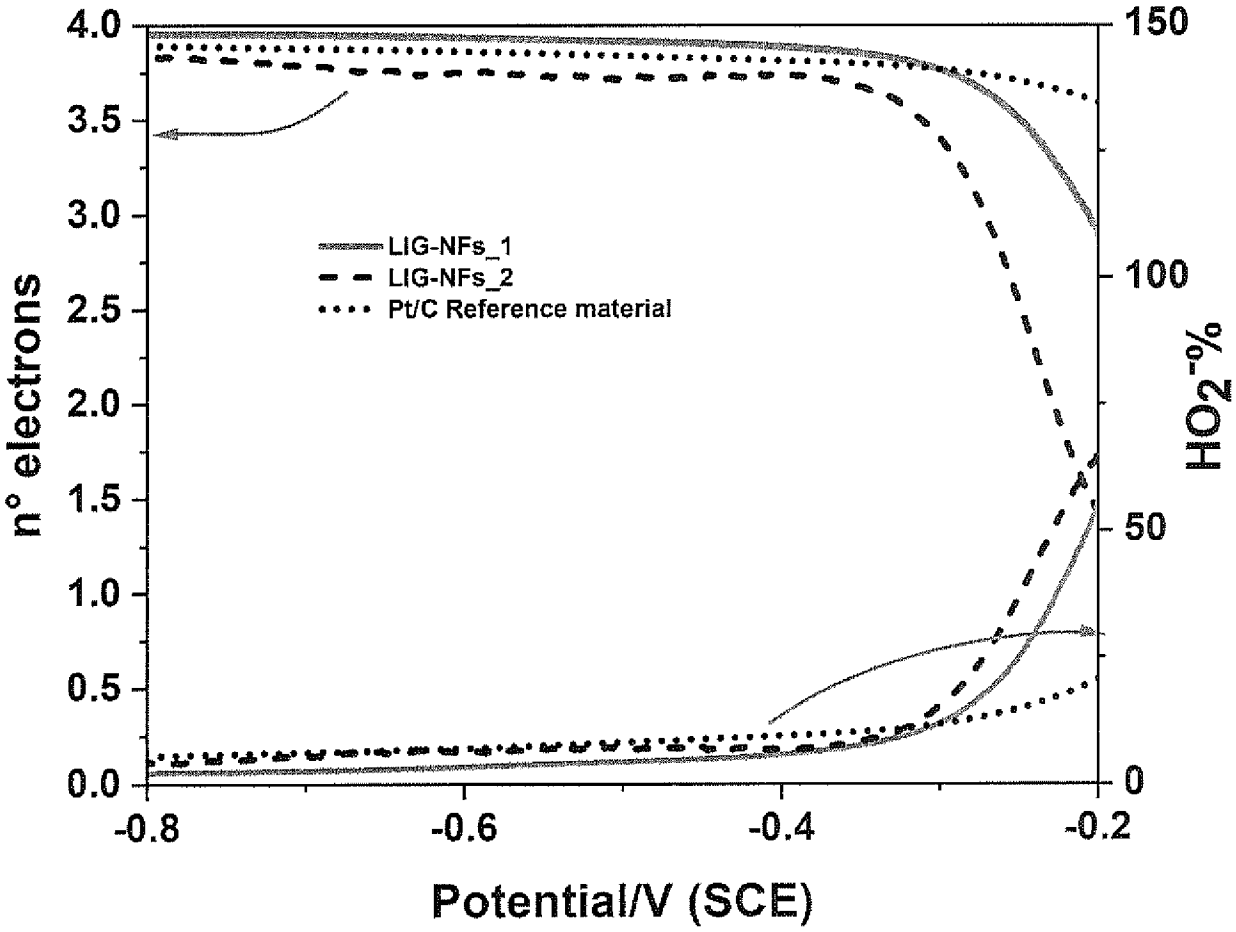
FIG. 9 shows the number of electrons supplied and the percentage of $H_2O_2$ established by the RRDE characterisations of the carbon materials obtained by laser writing (continuous and broken lines) compared with a commercial catalyst based on Pt/C.

In particular, the results shown in FIG. 9 demonstrate the electrochemical properties of the carbon material obtained by laser writing using the method according to the present invention, applied and implemented on PVDF nanofibres and compared with platinum used as reference. It will be observed that the number of electrons transferred by said material is close to 4, thus meeting the pre-set target.

The invention claimed is:

1. A process for carbonization of synthetic polymers which comprises:

a) forming nano- or micro-structured films or fibres of said polymers;

b) treating the fibres or films obtained in step a) with alkaline solutions of alkali hydroxides in $C_2$-$C_4$ alcohols with a treatment duration of from 10 minutes to 2 hours at room temperature;

c) treating the fibres or films obtained in step b) with a $CO_2$ laser in the presence of air, and at a temperature of about 20-25° C.;

wherein the synthetic polymers are selected from polyvinyl chloride, polyvinyl alcohol, polyethylene, polyethylene terephthalate, polyethylene naphthalate, polystyrene, polypropylene, polycarbonates, nylon 6,6, polymethacrylates, urea-formaldehyde resins, melamine-formaldehyde resins, TEFLON, polylactate, polyurethanes, polyesters, fluorinated ethylene propylene copolymers, acrylonitrile butadiene styrene, polyacrylonitrile and polyvinylidene fluoride; and wherein the concentration of alkali hydroxides in the alkaline solutions of step b) ranges between 0.01 and 0.5M.

2. The process according to claim 1 wherein the nano- or micro-structured fibres are obtained in step a) by electrospinning.

3. The process according to claim 1, wherein the polymers of step a) are selected from polyacrylonitrile and polyvinylidene fluoride.

4. The process according to claim 1, wherein the alkaline treatment of step b) is performed by immersion of the polymer of step a) in solutions of $C_1$-$C_4$ alcohols of alkali hydroxides.

5. The process according to claim 4 wherein the alkaline treatment of step b) is performed by immersion of the polymer of step a) in ethanol solutions of alkali hydroxides.

6. The process according to claim 1, wherein the alkali hydroxides are selected from NaOH and KOH.

7. The process according to claim 1, wherein the concentration of alkali hydroxides ranges between 0.01 and 0.1M.

8. The process according to claim 6, wherein the alkali hydroxide is NaOH.

9. The process according to claim 7, wherein the concentration of alkali hydroxide ranges between 0.01 M and 0.05 M.

10. The process according to claim 7, wherein the concentration of alkali hydroxide is 0.05 M.

* * * * *